US009835167B2

(12) United States Patent
Haefner et al.

(10) Patent No.: US 9,835,167 B2
(45) Date of Patent: Dec. 5, 2017

(54) BLOWER HOUSING, ESPECIALLY FOR A SIDE CHANNEL BLOWER

(71) Applicant: Eberspächer Climate Control Systems GmbH & Co. KG, Esslingen (DE)

(72) Inventors: Michael Haefner, Stuttgart (DE); Andreas Alber, Stuttgart (DE)

(73) Assignee: Eberspächer Climate Control Systems GmbH & Co. KG, Esslingen (DE)

( * ) Notice: Subject to any disclaimer, the term of this patent is extended or adjusted under 35 U.S.C. 154(b) by 382 days.

(21) Appl. No.: 14/574,929

(22) Filed: Dec. 18, 2014

(65) Prior Publication Data

US 2015/0176598 A1 Jun. 25, 2015

(30) Foreign Application Priority Data

Dec. 19, 2013 (DE) ..... 10 2013 226 563

(51) Int. Cl.

| | |
|---|---|
| ***F04D 29/42*** | (2006.01) |
| ***F04D 29/62*** | (2006.01) |
| ***F04D 29/40*** | (2006.01) |
| ***F04D 29/60*** | (2006.01) |
| ***F04D 29/08*** | (2006.01) |
| ***F04D 23/00*** | (2006.01) |

(52) U.S. Cl.

CPC ..... *F04D 29/4206* (2013.01); *F04D 23/008* (2013.01); *F04D 29/083* (2013.01); *F04D 29/403* (2013.01); *F04D 29/60* (2013.01); *F04D 29/626* (2013.01); *Y10T 29/49245* (2015.01)

(58) Field of Classification Search

CPC .... F04D 29/083; F04D 29/626; F04D 29/403; F04D 29/4206; F04D 23/008; B60H 1/12; B60H 1/00528; B60H 2001/00635

See application file for complete search history.

(56) References Cited

U.S. PATENT DOCUMENTS

2013/0209247 A1* 8/2013 Herrmann ..... F04D 23/008 415/208.1

FOREIGN PATENT DOCUMENTS

| | | | | |
|---|---|---|---|---|
| CN | 101076670 A | 11/2007 | | |
| CN | 102410255 A | 4/2012 | | |
| CN | 102777393 A | 11/2012 | | |
| CN | 102874072 A | 1/2013 | | |
| DE | 14 28 246 A1 | 1/1969 | | |
| DE | 4029041 A1 | 4/1991 | | |
| DE | 20 2013 008 315 U1 | 2/2014 | | |
| IT | DE 202013008315 U1 * | 1/2014 | ..... | F04D 29/628 |

* cited by examiner

*Primary Examiner* — Ninh N Nguyen
*Assistant Examiner* — Brian P Wolcott
(74) *Attorney, Agent, or Firm* — McGlew and Tuttle, P.C.

(57) ABSTRACT

A blower housing, especially for a side channel blower, includes a first housing part (22) with a motor mounting space (25) for a blower motor (14). A rotor shaft (16), rotatable about a shaft axis of rotation (A), of a blower motor (14) is or can preferably be rotatably mounted at the first housing part (22). A housing cover (44) seals the motor mounting space (25). The housing cover (44) has a cover meshing opening (46). A second housing part (50), with a cover meshing projection (52), is positioned or can be positioned in a meshing manner in the cover meshing opening (46). The cover meshing opening (46) is sealed with the cover meshing projection (52) being positioned in a meshing manner in the cover meshing opening (46).

20 Claims, 4 Drawing Sheets

BLOWER HOUSING, ESPECIALLY FOR A SIDE CHANNEL BLOWER

CROSS REFERENCE TO RELATED APPLICATIONS

This application claims the benefit of priority under 35 U.S.C. §119 of German Patent Application DE 10 2013 226 563.8 filed Dec. 19, 2013, the entire contents of which are incorporated herein by reference.

FIELD OF THE INVENTION

The present invention present invention pertains to a blower housing, which can be used, for example, for a side channel blower of a vehicle heater.

BACKGROUND OF THE INVENTION

Such a side channel blower is generally used for delivering the combustion air needed for combustion in a fuel-operated vehicle heater in the direction of a combustion chamber.

SUMMARY OF THE INVENTION

An object of the present invention is to provide a blower housing, especially for a side channel blower, which, with a simple structure, makes possible the precise carrying out of assembly procedures in the assembly of a blower, especially a side channel blower.

According to the present invention, this object is accomplished by a blower housing, especially for a side channel blower, comprising:

- a first housing part with a motor mounting space for a blower motor, wherein a rotor shaft, rotatable about a shaft axis of rotation, of a blower motor is or can preferably be rotatably mounted at the first housing part,
- a housing cover for sealing the motor mounting space, wherein the housing cover has a cover meshing opening,
- a second housing part with a cover meshing projection, which is positioned or can be positioned in a meshing manner in the cover meshing opening, wherein the cover meshing opening is sealed with the cover meshing projection being positioned in a meshing manner in the cover meshing opening.

In the blower housing constructed according to the present invention, it is made sure by providing the cover meshing opening, on the one hand, that there is access to the end of the rotor shaft lying in the interior of the motor mounting space when mounting a delivery wheel in order to support this rotor shaft axially and thus to prevent an unintended shifting of same during the mounting of the delivery wheel. Further, the meshing interaction between the cover meshing projection and the cover meshing opening guarantees a sealing of the cover meshing opening after assembly of a delivery wheel, such that the cover meshing opening can be reliably sealed against the entry of particles or liquid by mounting the second housing part at the first housing part without additional assembly steps and without additional components.

In order to design the access to the end area of the rotor shaft lying in the motor mounting space as simple as possible during the mounting of a delivery wheel onto the rotor shaft, it is suggested that the cover meshing opening be arranged in the area of the shaft axis of rotation with the housing cover positioned at the first housing part.

A defined fastening interaction between the first housing part and the housing cover can be achieved, for example, by the first housing part comprising a circumferential wall enclosing the motor mounting space, and by the housing cover having a ring-like housing meshing area, which can be positioned in a meshing manner in an axial end area of the circumferential wall and being supported on an inner surface of the circumferential wall preferably with the intermediate mounting of a ring-like first sealing element. Of course, steps may additionally be provided, for example, the insertion of fastening screws in order to, with the housing cover mounted at the first housing part, entirely eliminate its release from the first housing part.

Especially when using the blower housing according to the present invention for a side channel blower, provisions may be made for the first housing part to have a bottom area, wherein a mounting attachment is provided at the bottom area for the rotor shaft, or/and a ring-like delivery channel open in a first axial direction, surrounding the shaft axis of rotation, is provided. Thus, the first housing part fulfils, besides the functionality for accommodating the blower motor, also the functionality for mounting the rotor shaft as well as the functionality for providing a flow space for the air to be delivered in the blower operation.

In the blower housing according to the present invention, the circumferential wall may extend from the bottom area in a second axial direction opposite the first axial direction.

In order to make the meshing of the cover meshing projection in the cover meshing opening easier during the mounting of the second housing part, but to guarantee a tight meshing, on the other hand, it is further suggested that the cover meshing opening is or can be positioned in a meshing manner in the cover meshing opening with intermediate mounting of a ring-like second sealing element.

For providing an electrical contacting of the blower motor accommodated in the motor mounting space, it is further suggested that at least one lead-through opening be provided in the housing cover for a connection line of a blower motor. One or more such lead-through openings may be provided laterally next to the cover meshing opening in relation to the shaft axis of rotation of the rotor shaft. In order to also guarantee a tight sealing for such connection lines electrically connecting the blower motor, it is suggested that a connection line sealing attachment be provided at the second sealing element in association with at least one lead-through opening, wherein the connection line sealing attachment comprises a connection line opening for the tight leading through of a connection line and a sealing formation for the tight accommodation of the connection line sealing attachment in a sealing attachment receptacle of the second housing part.

In the structure according to the present invention a comparatively precise positioning of the second housing part in relation to the housing cover and thus also in relation to the first housing part can already be provided by the meshing of the cover meshing projection in the cover meshing opening. In order to be able to define this positioning more exactly, it is suggested that a centering formation be provided at the housing cover laterally next to the cover meshing opening in relation to the shaft axis of rotation and a counter-centering formation, in or capable of being brought into centering meshing with the centering formation, is provided at the second housing part. Provisions may be made here, for example, for a formation of centering formation and counter-centering formation to comprise at least one centering projection projecting in the direction of the shaft axis of rotation and for the other formation of centering formation and counter-centering formation to comprise at least one centering projection mount open in the direction of the shaft axis of rotation for accommodating a centering projection.

A blower motor control device, for example, may be provided at the second housing part.

The present invention further pertains to a side channel blower, especially for a fuel-operated vehicle heater, comprising a housing arrangement constructed according to the present invention, wherein a blower motor is arranged in the motor mounting space and a rotor shaft of the blower motor is preferably rotatably mounted at the first housing part about a shaft axis of rotation, wherein a delivery wheel is carried at an end area of the rotor shaft traversing a bottom area of the first housing part. In case of connection of the delivery wheel to the rotor shaft to be established in a simple manner using the cover meshing opening, it is suggested that the delivery wheel be pressed onto the rotor shaft with a carrying attachment.

The present invention further pertains to a method for the assembly of a side channel blower with the structure described above. This method may comprise the following steps:

a) providing the first housing part with the blower motor and the rotor shaft and the housing cover as a preassembly assembly unit, b) mounting the delivery wheel at the end area of the rotor shaft traversing the bottom area of the first housing part and thereby supporting the other end area of the rotor shaft through the cover meshing opening, c) inserting the second housing part with its cover meshing projection into the cover meshing opening.

The present invention is described in detail below with reference to the attached figures. The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

Figure 1:
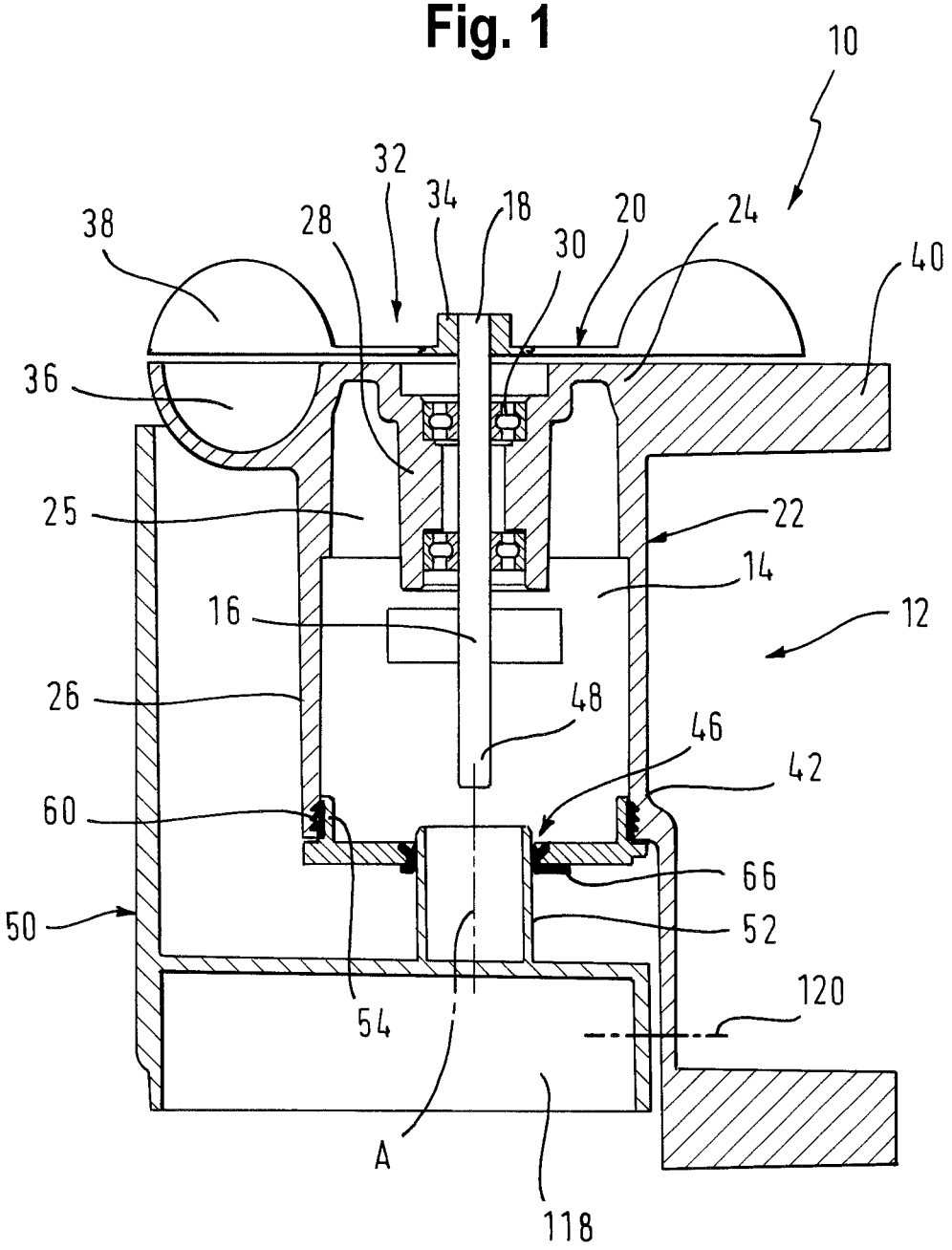
FIG. 1 is a longitudinal sectional view of a side channel blower.

Referring to the drawings, FIG. 1 shows a side channel blower 10, which comprises as essential system components a blower housing 12, in the blower housing 12 a blower motor 14, indicated only schematically, with a rotor 16 and a delivery wheel 20 carried at an end area 18 of the rotor shaft 16.

Blower housing 12 comprises a first housing part 22 with a bottom area 24 and a circumferential wall 26 starting from the bottom area 24. The circumferential wall 26 encloses a motor mounting space 25 for the blower motor 14. A mounting attachment 28, in which the rotor shaft is preferably rotatably mounted about a shaft axis of rotation A via one or more pivot bearings 30, extends from the bottom area 24 into the motor mounting space 25 in such a way that the end area 18 of the rotor shaft 16 extends on a first axial side 32 of the bottom area 22 beyond this bottom area. The delivery wheel 20 is carried at this end area 18 with a carrying attachment 34 provided centrally thereon. As an alternative, the rotor shaft 16 could be mounted, e.g., at a motor housing arranged in the motor mounting space 25.

Further, a delivery channel 36, extending in a ring-like manner about the rotor shaft 16 or the shaft axis of rotation A, which is axially open in a first axial direction, i.e., in the upwards direction in the view of FIG. 1 and is axially overlapped by a delivery area 38 of the delivery wheel 20, which delivery area has a correspondingly ring-like design and is provided with feed blades, is designed at the bottom area of the first housing part 2. In this configuration, the circumferential wall 26 extends in a second axial direction opposite this first axial direction, i.e., downwards in the view of FIG. 1. In a circumferential area of the bottom area 24, the delivery channel 36 is interrupted by means of an interrupter area 40, such that the air delivered by the rotation of the delivery wheel 20 in the circumferential direction along the delivery channel 36 can leave the delivery channel 36 via an air outlet, which is also formed in the interrupter area 40.

The motor mounting space 25 is sealed by a housing cover 44 at an axial end area 42, at a distance from the bottom area 24, of the circumferential wall 26. The housing cover 44 shown in detail in FIG. 2 has basically a ring-like or ring-disk-like shape with a cover meshing opening 46 formed in a central area of same. The cover meshing opening 46 is positioned at the housing cover 44, such that it lies essentially concentric to the shaft axis of rotation A and thus also to the rotor shaft 16 with the housing cover 44 mounted at the circumferential wall 26, such that there is access to the end area 48 of the rotor shaft 16 lying in the motor mounting space 25 in a simple manner through this cover meshing opening 46.

A cover meshing projection 52 is provided at a second housing part 50. This cover meshing projection has an outer circumferential contour corresponding to the inner circumferential contour of the cover meshing opening 46. For example, the cover meshing opening 46 and the cover meshing projection 52 can each be designed with a circular circumferential contour. It is further recognized in FIG. 1 that the cover meshing projection has an essentially cylindrical design and is provided in its free end area with a lead-in bevel 76, which makes the easy insertion into the cover meshing opening 46 possible.

In order to guarantee a tight sealing of the motor mounting space 25 by means of the housing cover 44, this housing cover has a ring-like housing meshing area 54, designed as preferably essentially continuous in the circumferential direction. A first sealing element 60, which has a, for example, ring-like design, lies, in the housing meshing area 54 meshing in the circumferential wall 26, between its outer surface 56 and an inner surface 58 of the circumferential wall 26 opposite this. This first sealing element, which is designed, for example, with a plurality of preferably ring-like, circumferential sealing ribs or sealing lips 62, provides, on the one hand, for the above-mentioned tight sealing in the area of the adjoining of the housing cover 44 to the circumferential wall 26 of the first housing part 12 and furthermore provides for a stable holding of the housing cover 44 at the first housing part 12. In order to reliably secure the housing cover 44 against a release from the first housing part 12, a plurality of mounting straps 64 may be provided at the housing cover 44, through which fastening elements, for example, fastening screws, can be inserted into corresponding areas of the first housing part 12.

Figure 2:
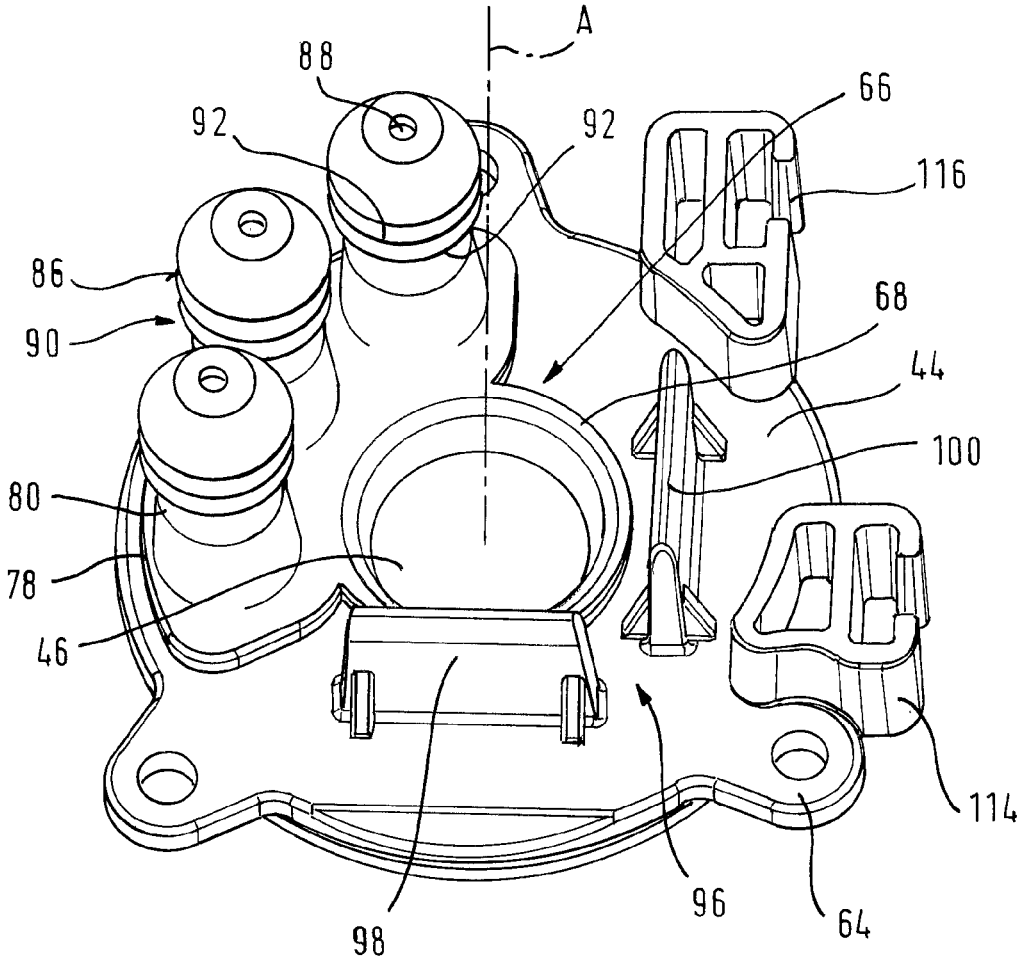
FIG. 2 is a perspective view of a housing cover of a blower housing of the side channel blower shown in FIG. 1.
Figure 3:
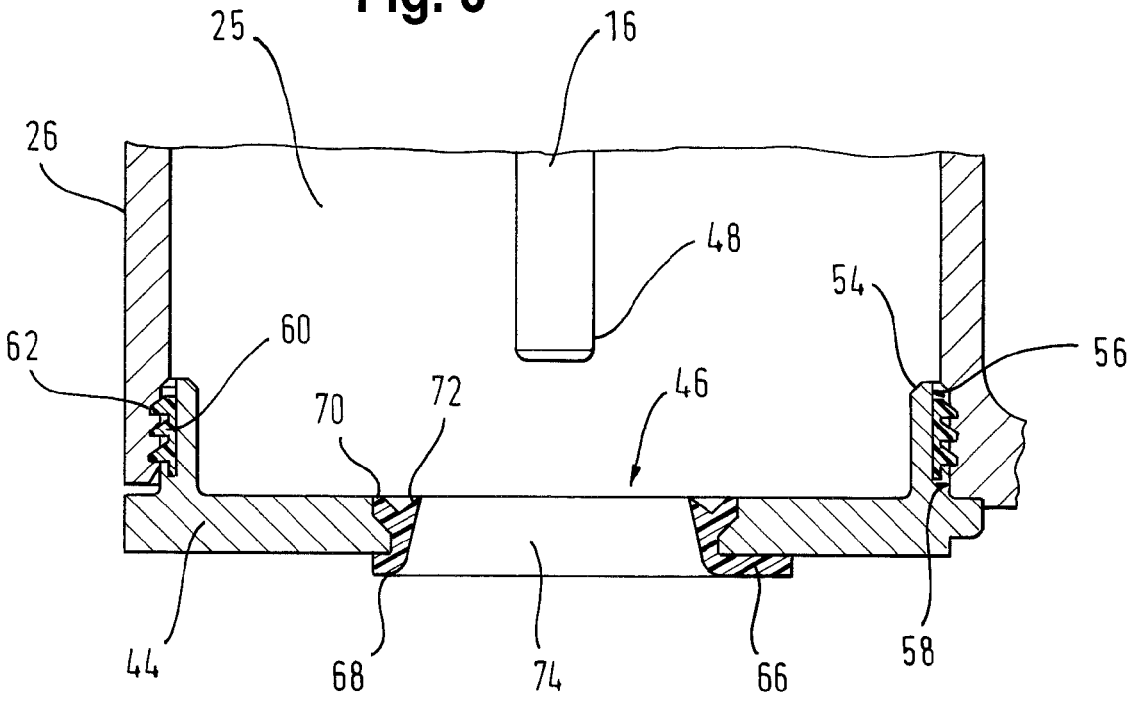
FIG. 3 is an enlarged view of a housing cover mounted at a first housing part.
Figure 4:
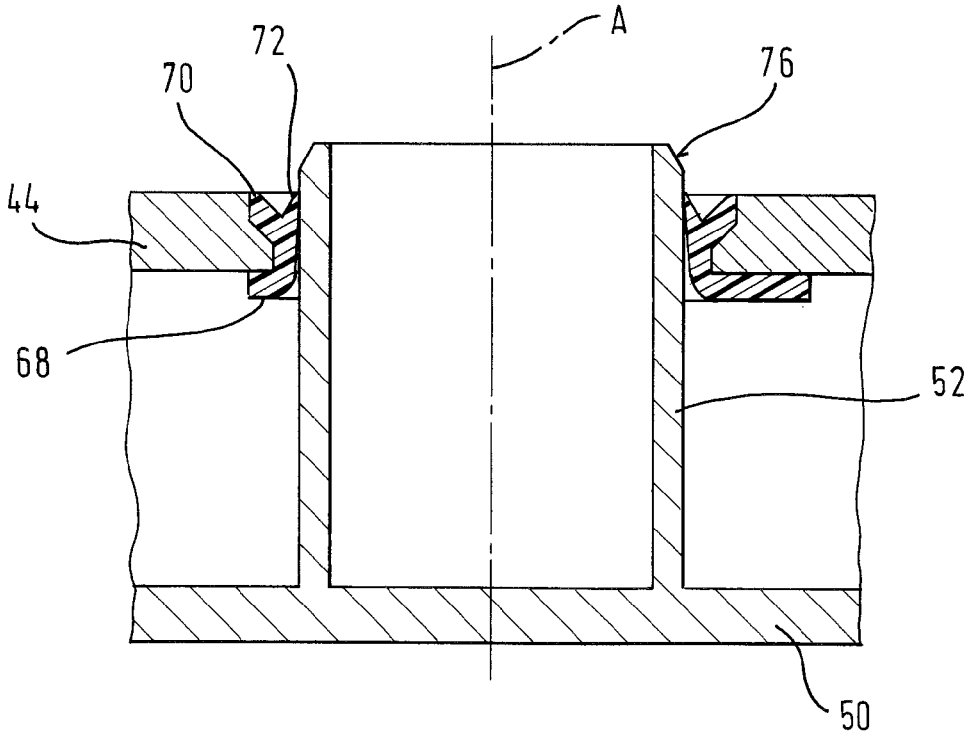
FIG. 4 is the central area of the housing cover with a cover meshing projection of a second housing part meshing in a cover meshing opening.
Figure 5:
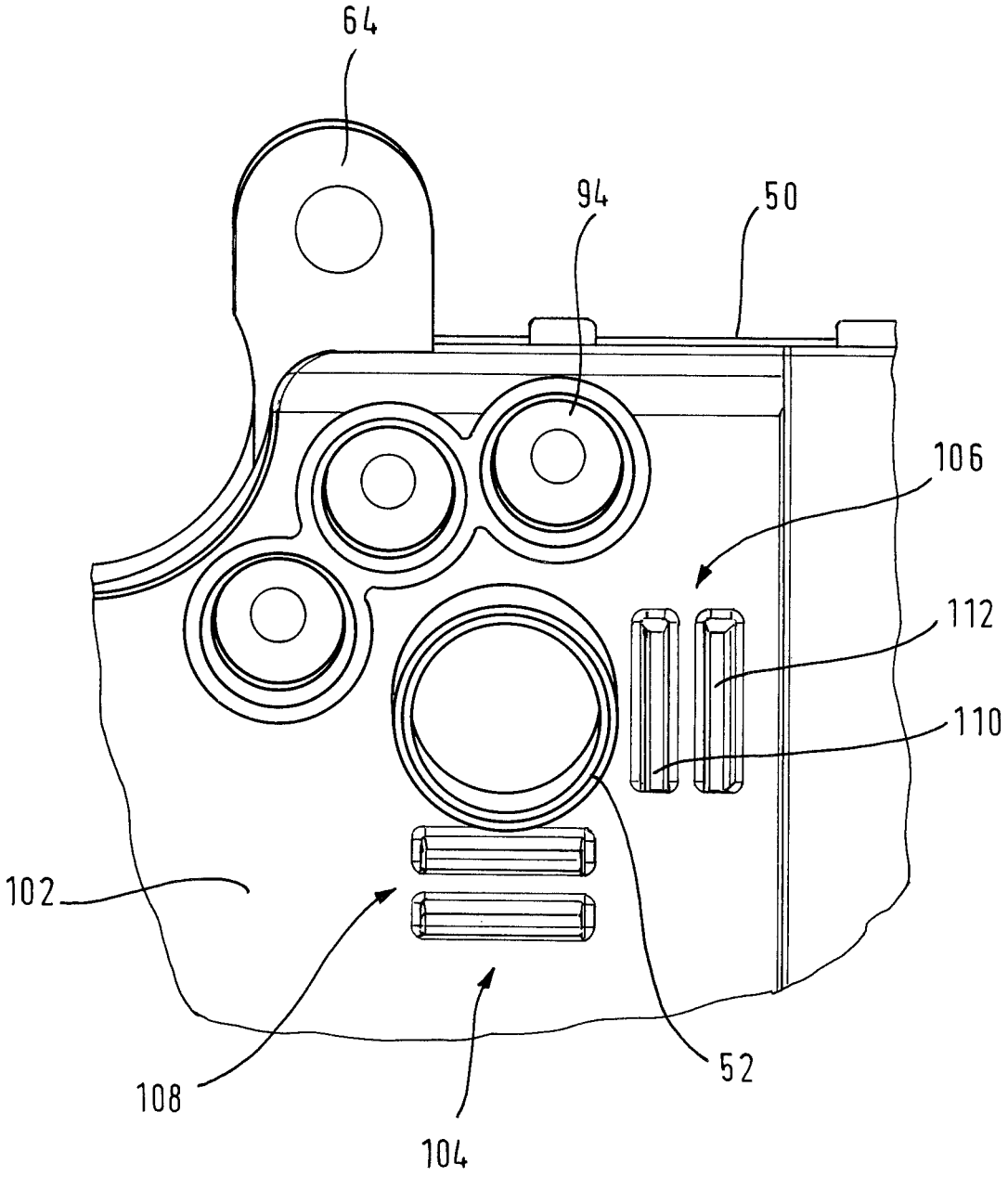
FIG. 5 is a partial view of the second housing part as viewed from its side to be positioned facing toward the housing cover.

In order to make the meshing of the cover meshing projection 52 in the cover meshing opening 46 tight as well, a second sealing element 66, which is also recognizable in FIG. 2, is provided. This second sealing element 66 comprises a ring-like first sealing area 68, which can be positioned in a meshing manner in the cover meshing opening 46 and can be designed with a, for example, Y-like cross-sectional geometry, such that sealing ribs or sealing lips 70, 72 are provided, which can be positioned at the housing cover 44, on the one hand, and at the cover meshing projection 52, on the other hand. In the meshing positioning of the cover meshing projection 52 shown in FIG. 4, the sealing lip 70 abuts against the housing cover 44, while the sealing lip 72 abuts against the cover meshing projection 52. It can especially be recognized in FIG. 3 that the ring-like first sealing area 68 provides a receiving opening 74, for example, conically tapering in the direction of the motor mounting space 25, which [receiving opening], in conjunction with the lead-in bevel 76 at the axial end area of the cover meshing projection 52, makes possible, on the one hand, an insertion of the cover meshing projection, which is simple and avoids damages at the first sealing area 68, but, on the other hand, also provides for a fluid-tight abutting against the outer circumference of the cover meshing projection 52 because of the design of the second sealing element 66 made of elastic material, for example, rubber material or the like.

Figure 6:
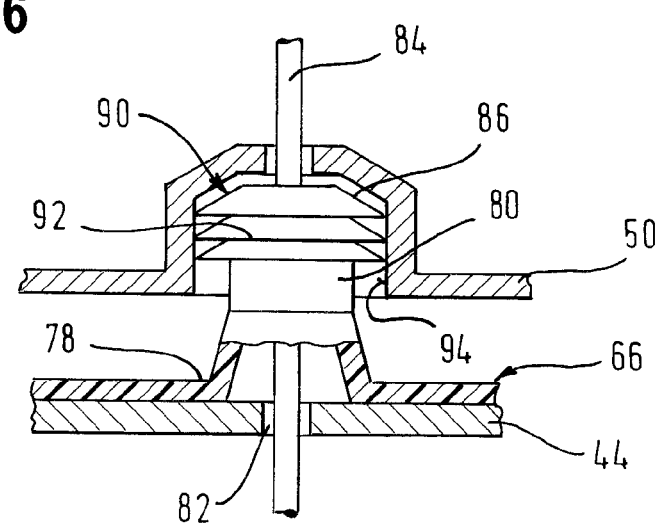
FIG. 6 is a schematic diagram of a connection line sealing attachment, meshing in a sealing attachment receptacle of the second housing part, of a sealing element also provided for sealing the cover meshing projection in the cover meshing opening.

Further, the second sealing element 66 has a second sealing area 78, which is laterally adjacent to the first sealing area 68 in relation to the shaft axis of rotation A. In this second sealing area 78 are provided a plurality, three in the example shown, of connection line sealing attachments 80, which essentially extend away from the housing cover 44 in the direction of the shaft axis of rotation A. These connection line sealing attachments 80 are positioned at the second sealing element 66 in association with lead-through openings 82 provided at the housing cover 44 for connection lines 84 provided for the electrical contacting of the blower motor 14. It should be pointed out here that the lead-through openings 82, as this is schematically shown in FIG. 6, may be designed as hole-like lead-throughs in the housing cover 44, which has an essentially planar design, or may be designed as attachments extending from the housing cover 44 in the second axial direction into the connection line sealing attachments 80.

The connection line sealing attachments 80 are designed, in their end area 86 lying at a distance from the housing cover 44, with a connection line opening 88, through which a connection line 84 each can be led, wherein the dimensioning of the connection line openings 88 is such that the connection line sealing attachments 80 abut tightly against the outer surface of the connection lines 84 in this area.

In the end area 86, the connection line sealing attachments 80 further have a sealing formation 90, for example, comprising a plurality of ring-like sealing ribs or sealing lips 92. With the second housing part 50 mounted at the first housing part 22, a respective end area 86 of a connection line sealing attachment 80 meshes with a sealing attachment receptacle 94 of the second housing part 50, such that the sealing formation 90 guarantees a tight sealing, as a result of which in the passage from the housing cover 44 to the second housing part 50 a completely tight sealing is guaranteed for the connection lines 84 leading through both the housing cover 14 and the second housing part 50.

A positioning of the second housing part 50 in relation to the first housing part 22 is already basically provided by the meshing of the cover meshing projection 52 in the cover meshing opening 46. Especially when the cover meshing projection 52 and the cover meshing opening 46 are designed with a circular contour, a rotation of the second housing part 50 in relation to the first housing part 22 would, however, be possible. In order to prevent this or to preset a further defined positioning for the second housing part 50 in relation to the first housing part 22, a centering formation 96 is provided at the housing cover 44. This [centering formation] comprises two centering projections 98, 100, extending essentially in the direction of the shaft axis of rotation A, laterally next to the cover meshing opening 46 in relation to the shaft axis of rotation A. These centering projections may have, for example, a wall-like design and be arranged at an angle of approx. 90° in relation to one another. A counter-centering formation 104 is provided on the side 102 of the second housing part 50 to be positioned facing toward the housing cover 44. This counter-centering formation has two centering mounts 106, 108 open in the direction of the shaft axis of rotation A. Each of these centering mounts 106, 108 may be formed, for example, by two counter-centering projections 110, 112, which are arranged at such a distance from one another that a respective centering projection 98 or 100 can be mounted between them.

If the second housing part 50 is led up to the housing cover 44 in the direction of the shaft axis of rotation A, then the cover meshing projection 52 enters the cover meshing opening 46 in the course of this movement, on the one hand. On the other hand, the centering projections 98, 100 mesh with the centering projection mounts 106, 108, such that a defined rotational positioning of the second housing part 50 in relation to the housing cover 44, which is already fixed to the first housing part 22, is achieved. The insertion motion can be continued until, for example, the centering projections 98, 100 abut against the second housing part 50 or/and the counter-centering projections 110, 112 of the centering projection mounts 106, 108 abut against the housing cover 44. In order to carry out the leading-up motion of the second housing part at the housing cover 44 in a defined manner already in a condition, in which neither does the cover meshing projection 52 mesh with the cover meshing opening 56, nor is the centering interaction between the centering formation 96 and the counter-centering formation 104 generated, one or more guiding profiles 114, 116, into which correspondingly shaped counter-guiding profile tracks can be inserted at the second housing part 50 and guided therein, may be provided at the housing cover 44.

In the assembly of the side channel blower 10 shown in FIG. 1, it is possible to proceed, such that in a first assembly phase, the first housing part 22 with the blower motor 14, especially also its rotor shaft 16, and with the housing cover 44 are assembled into a preassembly assembly unit. Here, for example, the housing cover 44 may already be provided as a partial component of the blower motor 14 or of a stator assembly unit of same and be pressed together with the blower motor 14 into the motor mounting space 25 and be fixed to the first housing part 22.

In a second assembly phase, the delivery wheel 20 can then be mounted on this preassembly assembly unit. Here, the delivery wheel 20 with its carrying attachment 34 is pressed axially onto the end area 18 of the rotor shaft 16. In order to prevent a shifting of this rotor shaft 16 or of the rotor or of the blower motor 14, an abutment can be formed with a support tool through the cover meshing opening 46, at which the end area 48 of the rotor shaft 16 can be supported. In a then, next third assembly phase, the second housing part 50, which may carry a control device, not shown in the figures, for the blower motor 14 in a mounting space 118, can then be axially led up in the above-described manner until meshing of the cover meshing projection 52 with the cover meshing opening 46 is achieved. In the course of this axial motion, the centering meshing between the centering formation 96 and the counter-centering formation 104 is then also achieved. In order to be able to then also maintain a defined axial positioning between the first housing part 22 and the second housing part 50 in this condition, i.e., to prevent an unintended shifting of the second housing part 50 in the direction of release from the housing part 22, mounting elements 120, which are designed, for example, as screw bolts or the like and are only schematically indicated by dotted line in FIG. 1, can be led through these two housing parts 22, 50, for example, screwed through. Further, the connection line sealing attachments 80, which have already been passed through by the connection lines 84, enter the sealing attachment receptacles 94 provided in the second housing part 50. In the course of this insertion motion, an electrical connection between the connection lines 84 and the control device provided at the second housing part 50, for example, can be produced at the same time. For example, the connection lines 84 may be designed as plug contacts, which can enter corresponding plug contact receptacles of the control device.

With the above-described structure of a blower housing for a side channel blower, the assembly of the side channel blower is made possible in a simple manner, wherein, after assembling the various housing parts, no openings to the motor mounting space of the blower housing permitting entry of contaminants or liquids remain. It should be pointed out that this advantageous design can also be achieved, of course, when one deviates from the structure described above with reference to the figures in the widest variety of structural manners. Thus, for example, more or fewer connection line sealing attachments may be provided at the second sealing element. Also, the cover meshing opening and the cover meshing projection may be designed with circumferential contours that are different, but are coordinated with one another.

While specific embodiments of the invention have been shown and described in detail to illustrate the application of the principles of the invention, it will be understood that the invention may be embodied otherwise without departing from such principles.

What is claimed is:

1. A side channel blower housing comprising:

a first housing part with a motor mounting space for a blower motor and with a rotor shaft mounting, wherein a rotor shaft, rotatable about a shaft axis of rotation, of a blower motor is rotatably mountable at the first housing part rotor shaft mounting;

a housing cover for sealing the motor mounting space, wherein the housing cover has a cover meshing opening arranged in an area through which the shaft axis of rotation passes, wherein the cover meshing opening provides access to an end area of the rotor shaft lying in the motor housing space with the housing cover positioned at and connected to the first housing part; and a second housing part with a cover meshing projection, which cover meshing projection is positionable in a meshing manner in the cover meshing opening, wherein the cover meshing opening is sealed with the cover meshing projection being positioned in a meshing manner in the cover meshing opening.

2. A side channel blower housing in accordance with claim 1, wherein:

the first housing part comprises a circumferential wall enclosing the motor mounting space; and the housing cover has a ring housing meshing area, which can be positioned in a meshing manner in an axial end area of the circumferential wall.

3. A side channel blower housing in accordance with claim 2, further comprising a ring sealing element, wherein the ring housing meshing area is supported on an inner surface of the circumferential wall with an intermediate mounting of the ring sealing element between the meshing projection and the cover meshing opening.

4. A side channel blower housing in accordance with claim 1, wherein:

the first housing part has a bottom area; and the bottom area has at least one mounting attachment for the rotor shaft and has a ring delivery channel open in a first axial direction, said ring delivery channel surrounding the shaft axis of rotation.

5. A side channel blower housing in accordance with claim 4, wherein the circumferential wall extends from the bottom area in a second axial direction opposite the first axial direction.

6. A side channel blower housing in accordance with claim 1, further comprising a ring sealing element, wherein the cover meshing projection is positioned in a meshing manner in the cover meshing opening with an intermediate mounting of the ring sealing element between the meshing projection and the cover meshing opening.

7. A side channel blower housing in accordance with claim 1, wherein at least one lead-through opening is provided in the housing cover for a connection line of the blower motor.

8. A side channel blower housing in accordance with claim 7, further comprising:

a ring sealing element, wherein the cover meshing projection is positioned in a meshing manner in the cover meshing opening with intermediate mounting of the ring sealing element; and a connection line sealing attachment provided at the ring sealing element in association with at least one lead-through opening, wherein the connection line sealing attachment comprises a connection line opening for a leading through of a connection line and a sealing formation for mounting of the connection line sealing attachment in a sealing attachment receptacle of the second housing part.

9. A side channel blower housing in accordance with claim 1, wherein:

a centering formation is provided at the housing cover laterally next to the cover meshing opening in relation to the shaft axis of rotation; and a counter-centering formation, for being brought into centering meshing with the centering formation, is provided at the second housing part.

10. A side channel blower housing in accordance with claim 9, wherein:

a formation of the centering formation and the counter-centering formation comprises at least one centering projection projecting in the direction of the shaft axis of rotation; and another formation of the centering formation and the counter-centering formation comprises at least one centering projection mount open in the direction of the shaft axis of rotation for the accommodation of a centering projection.

11. A side channel blower housing in accordance with claim 1, wherein a blower motor control device is provided at the second housing part.

12. A side channel blower housing in accordance with claim 1, wherein:

the first housing part has a bottom area comprising a ring delivery channel open in a first axial direction, said ring delivery channel surrounding the shaft axis of rotation; and the bottom area further comprises a mounting attachment forming the rotor shaft mounting with the shaft axis of rotation, said mounting attachment extending in a second axial direction and toward said cover meshing opening of said housing cover.

13. A side channel blower for a fuel-operated vehicle heater, the side channel blower comprising:

a blower motor;

a rotor shaft;

a delivery wheel; and a housing arrangement comprising a first housing part with defining a motor mounting space, the blower motor being arranged in the motor mounting space, and with a rotor shaft mounting portion, wherein the rotor shaft, rotatable about a shaft axis of rotation, of the blower motor is rotatably mountable mounted at the first housing part rotor shaft mounting portion;

a housing cover for sealing the motor mounting space, wherein the housing cover has a cover meshing opening arranged in an area through which the shaft axis of rotation passes, wherein the cover meshing opening provides access to an end area of the rotor shaft lying in the motor housing space with the housing cover positioned at and connected to the first housing part; and a second housing part with a cover meshing projection, which cover meshing projection is connected in a meshing manner in the cover meshing opening, wherein the cover meshing opening is sealed with the cover meshing projection positioned in a meshing manner in the cover meshing opening, wherein the delivery wheel is carried at an end area of the rotor shaft traversing a bottom area of the first housing part.

14. A side channel blower in accordance with claim 13, wherein the delivery wheel is pressed onto the rotor shaft with a carrying attachment.

15. A side channel blower in accordance with claim 13, further comprising a ring sealing element wherein:

the first housing part comprises a circumferential wall enclosing the motor mounting space;

the housing cover has a ring housing meshing area, which can be positioned in a meshing manner in an axial end area of the circumferential wall; and the ring housing meshing area is supported on an inner surface of the circumferential wall with the intermediate mounting of the ring sealing element.

16. A side channel blower in accordance with claim 13, wherein at least one lead-through opening is provided in the housing cover for a connection line of the blower motor.

17. A side channel blower in accordance with claim 16, further comprising:

a ring sealing element wherein the cover meshing projection is positioned in a meshing manner in the cover meshing opening with intermediate mounting of the ring sealing element; and a connection line sealing attachment provided at the ring sealing element in association with at least one lead-through opening, wherein the connection line sealing attachment comprises a connection line opening for a leading through of a connection line and a sealing formation for mounting of the connection line sealing attachment in a sealing attachment receptacle of the second housing part.

18. A side channel blower in accordance with claim 13, wherein:

a centering formation is provided at the housing cover laterally next to the cover meshing opening in relation to the shaft axis of rotation; and a counter-centering formation, for being brought into centering meshing with the centering formation, is provided at the second housing part.

19. A method for the assembly of a side channel blower, the method comprising the steps of:

providing a blower motor, a rotor shaft, a delivery wheel a first housing part with a motor mounting space and with a rotor shaft mounting, a housing cover for sealing the motor mounting space, wherein the housing cover has a cover meshing opening and a second housing part with a cover meshing projection;

providing a preassembly assembly unit comprising the first housing part with the blower motor mounted in the motor mounting space and the rotor shaft mounted at the rotor shaft mounting and the housing cover attached to the first housing part;

mounting the delivery wheel at the end area of the rotor shaft traversing the bottom area of the first housing part while supporting the other end area of the rotor shaft through the cover meshing opening of the housing cover of the preassembly assembly unit; and inserting the second housing part with its cover meshing projection into the cover meshing opening.

20. The method in accordance with claim 19, wherein:

a centering formation is provided at the housing cover laterally next to the cover meshing opening in relation to the shaft axis of rotation; and a counter-centering formation, for being brought into centering meshing with the centering formation, is provided at the second housing part.

* * * * *